US006368076B1

(12) United States Patent
Zoland et al.

(10) Patent No.: US 6,368,076 B1
(45) **Date of Patent: *Apr. 9, 2002**

(54) AIR-FLOW MODIFYING NOZZLE

(76) Inventors: Martin Zoland, 7 Mandeville Crescent, Toorak, Victoria 3142; Jack Ian Strom, 17 Burrindi Rd., Caulfield South, Victoria 3162, both of (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/920,668

(22) Filed: Aug. 29, 1997

Related U.S. Application Data

(63) Continuation-in-part of application No. 08/768,445, filed on Dec. 18, 1996, now abandoned, which is a continuation of application No. 08/578,225, filed on Dec. 26, 1995, now abandoned, which is a continuation-in-part of application No. 08/438,496, filed on May 10, 1995, now abandoned.

(51) Int. Cl.[7] ..... A47L 5/14; F04B 17/00
(52) U.S. Cl. ..... 417/407; 15/345; 417/408
(58) Field of Search ..... 15/345, 387; 417/405, 417/406, 408

(56) References Cited

U.S. PATENT DOCUMENTS

| | | | | | |
|---|---|---|---|---|---|
| 987,820 | A | * | 3/1911 | Parker | 15/387 |
| 1,002,521 | A | * | 9/1911 | Kenney | 417/405 |
| 1,996,019 | A | * | 3/1935 | Hueber | 417/407 |
| 2,169,234 | A | * | 8/1939 | Ponomareff | 417/408 |
| 2,272,037 | A | * | 2/1942 | Horton | 417/407 |
| 2,717,118 | A | * | 9/1955 | Walter | 417/408 |
| 3,328,827 | A | * | 7/1967 | Lake et al. | 15/345 |
| 4,651,381 | A | * | 3/1987 | Meidel | 15/387 |

FOREIGN PATENT DOCUMENTS

| | | | | |
|---|---|---|---|---|
| DE | 923518 | * | 2/1955 | 417/408 |

* cited by examiner

*Primary Examiner*—Michael Koczo
(74) *Attorney, Agent, or Firm*—Blakely Sokoloff Taylor & Zafman

(57) ABSTRACT

A device for reversing and modifying air flow created by a suction device. The device has a housing, two fans, two pairs of inlet holes and a dividing wall. The fans are connected by a shaft, so that when the first fan rotates, the second fan rotates in the same direction. The fans are alike but have opposite blade orientations, so that though the fans rotate in the same direction, they output air flow in opposing directions. The fans and air regions they manipulate are separated by the dividing wall. The first pair of air inlet holes provides air to the first fan and then to the suction device. The second pair of air inlet holes provide air to the second fan, which expels that air through a nozzle. The nozzle restricts and directs the expelled air for a specific use such as an air pump or blower. The device for modifying air flow can be fitted with a cowl that collects and directs air particles, disturbed by the nozzle expelled air, through the first pair of inlet holes and to the suction device. In a second embodiment, the blades of both fans are alike in orientation and deflectors are provided to the first inlet holes converting them to outlet holes. In this embodiment, the device is able to attach to a vehicle exhaust pipe and divert the exhaust while still expelling clean air through the nozzle.

24 Claims, 6 Drawing Sheets

AIR-FLOW MODIFYING NOZZLE

CROSS-REFERENCE TO RELATED APPLICATIONS

This application is a continuation-in-part of pending U.S. application Ser. No. 08/768,445, filed Dec. 18, 1996, now abandoned, which is a continuation of Ser. No. 08/578,225 filed Dec. 26, 1995, now abandoned, and which is a continuation-in-part of Ser. No. 08/438,496 filed May 10, 1995, now abandoned.

BACKGROUND OF THE INVENTION

1. Field of the Invention

The present invention relates to a nozzle for modifying the air flow generated by suction or exhaust flow of another device, such as a vacuum cleaner.

2. Background of the Invention

Very few conventional vacuum cleaners can act as blowers by attaching a hose to an outlet hole. Thus, a device is required which can effectively modify the air flow of a vacuum cleaner and transform that flow directing and reversing it to also act as an air pump.

Further, the blower and vacuum functions have always been separated, so that an operator could not vacuum while also using the device for blowing purposes. Thus, a device is required that can allow a vacuum cleaner to blow air to dislodge particles and clean the dislodged particles by suction in a simultaneous fashion.

In general, in order to perform a blowing operation, a device specially designed for such purposes as leaf blowing, debris blowing, air compression or inflating articles is needed.

SUMMARY OF THE INVENTION

It is therefore an object of this invention to provide a device which uses a source of relatively low pressure gas, such as the suction hole of a vacuum cleaner, and reverses the direction of generated air flow or other gas flow. The present invention relates to an air flow modifying and reversing device that is mechanically simple and self-powered. The device includes a main housing, two fans, a dividing wall, and two pairs of air inlet holes. The two fans have opposing blade orientations, but rotate simultaneously by way of a shaft that connects them. The first pair of inlet holes is disposed on the surface of the housing and near the first fan. Likewise, the second pair of inlet holes is disposed on the surface of the housing near the second fan. The dividing wall separates the first fan and its pair of air inlet holes from the second fan and its inlet holes. An external suction device, connected to the end of the device proximate to the first fan, creates airflow causing the first fan and second fan to rotate simultaneously. By rotating, the second fan draws air though the second pair of inlets and expels that air out through the end of the air flow modifying device terminating in a nozzle. The air exiting the nozzle may be pressure adjusted by varying the cross-sectional area of the nozzle or the inlet holes. Further, the nozzle may include gauges or other attachments to assist in using the air flow device to inflate tires and other inflatable articles. The end of the air flow modifying device proximate to the first fan may be fitted with adapters, connectors or tubes as is necessary to fit the air or other gas source onto the air flow modifying device. The device may be modified by attaching a cowl which collects particles, discharged by the air exiting the nozzle, and draws them into the suction device through the first inlet holes. In an alternate embodiment, the air flow device may have two fans with identical blade orientations, and a pair of deflectors near the first inlet holes, and appropriate connectors for diverting the exhaust air flow of a combustion engine vehicle and expelling clean air through the nozzle.

BRIEF DESCRIPTION OF THE DRAWINGS

The objects, features, and advantages of the present invention will become apparent to one skilled in the art from reading the detailed description which follows in which.

DETAILED DESCRIPTION OF THE INVENTION

The present invention detailed below provides an apparatus for modifying air flow generated by an external device. However, it will be apparent to one skilled in the art that these specific details are not needed. Though the embodiments are described in terms of modifying the flow of the suction of a vacuum cleaner or the exhaust from a vehicle, the invention may be utilized in a similar manner to handle any gaseous flow generated externally.

Figure 1:
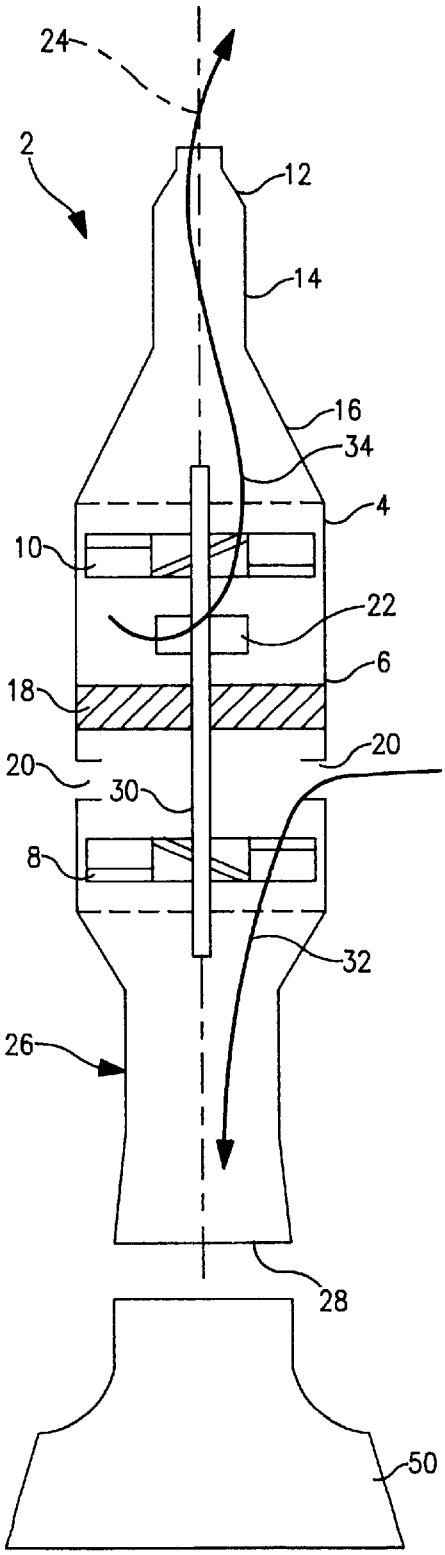
FIG. 1 shows a side sectional view of the air flow modifying device in its preferred embodiment.
Figure 2:
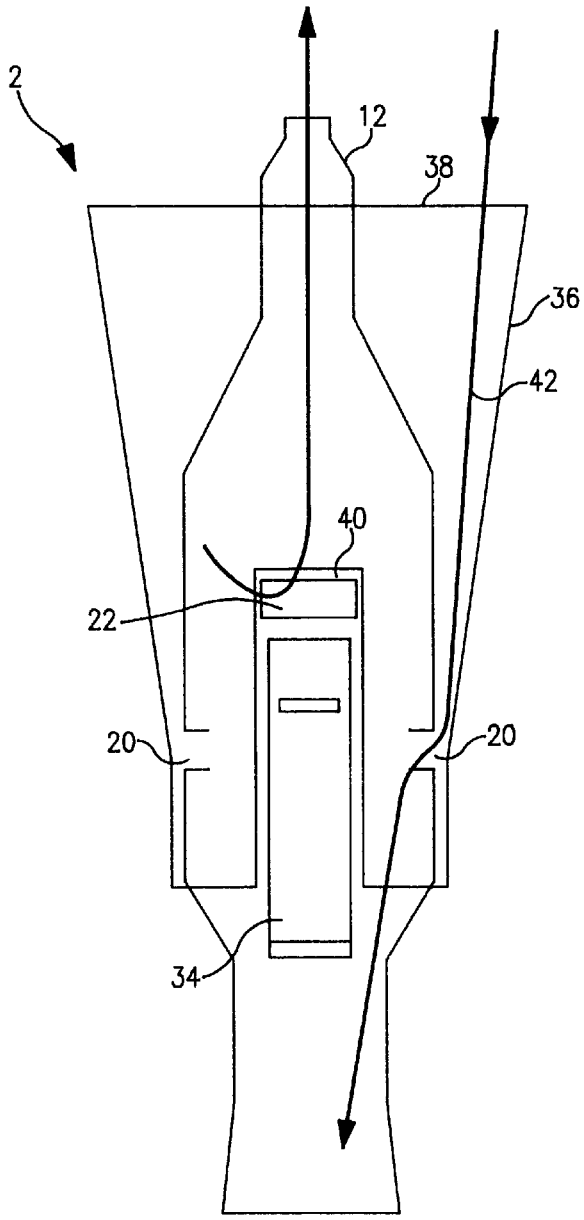
FIG. 2 shows a side view of the air flow modifying device of FIG. 1 fit with a cowl for collecting dust and particles.

An air flow device 2, as shown in FIGS. 1 and 2, has a tubular-shaped main housing 4 and includes a center portion 6 for housing a first fan 8 and a second fan 10 and an air outlet nozzle 12 which fits on the end of an air outlet tube 14. The air outlet tube 14 is connected to the center portion 6 by a tapered portion 16 which is frusto-conical or frusto-pyramidal in shape. The center portion 6 is divided into two sections by a dividing wall 18. The first section of the center portion 6 houses the first fan 8 and a first pair of air inlet holes 20 disposed on opposite sides in the surface wall of the center portion 6 of the housing 4. The second section of the center portion 6 houses the second fan 10 and a second pair of air inlet holes 22, with each hole disposed 180° apart from the other when measured along the circumference of the surface wall on the center portion 6 of the housing 4. The first pair of inlet holes 20 are 90° apart from the second pair of inlet holes 22 when measured along the circumference of the surface wall on the center portion 6.

The fans 8 and 10 each include a plurality of blades and are both mounted on central shaft 30 which is attached through the center of the fans 8 and 10 when the fans 8 and 10 rotate. The fans 8 and 10 are identical except that the orientation of the blades are reversed so that air flow created by the fan 8 will cause an airflow of fan 10 in the opposite direction. The central shaft 30 is a single component which penetrates through a hole dividing wall 18 at substantially its center. The hole at the center of the dividing wall 18 is of slightly larger diameter than the shaft permitting the shaft to rotate without resistance. Alternatively, the hole in the dividing wall 18 may be even larger if the hole includes a slip or bearing mechanism. A cog or gearing mechanism might also be used to gear fan speed if desired and the shaft would then be divided into two separate shafts.

A connecting tube 26 is fixed to the open end (which does not terminate in the dividing wall 18) of the first section of the center portion 6 containing the first fan 8. The connecting tube 26 includes an open connecting end 28 for attaching to the tube, nozzle, flange, pipe or other attachment provided by a suction device, such as a vacuum cleaner. The connecting end 28 should be able to make an interfacing friction-type fit with the tube or attachment provided by the suction device so that the head of the attachment provided by the suction device interlocks with the connecting end 28 forming a relatively air-tight seal. On the other end of the air flow device 2, as described above, the air outlet tube 14 is connected on the end of the center portion 6 containing the second fan 10. The first fan 8 is disposed between the first side inlets 20 and the connecting end 28, whereas the second fan 10 is disposed between the second side inlets 22 and the air outlet nozzle 12.

Once the air flow device 2 has had its connecting end 28 attached to the attachment of the suction device, the air flow device 2 can operate to reverse air flow as described below. Once the suction device has been activated it draws air into the connecting tube 26 from outside the air flow device 2 through the first inlets 20 and then through the first fan 8 in substantially the direction shown by flow line 32. This initial air flow from the first inlets 20 to the connecting tube 26 causes the first fan 8 to rotate. Since the second fan 10 is connected to the first fan 8 by the central shaft 30, as the first fan 8 rotates in one direction, the second fan 10 rotates correspondingly in the same direction. However, since the blades of fan 10 are reversed in angular orientation from the blades of fan 8, the fan 10 generates air flow in the opposite direction as shown by flow line 34, thereby forcing air out through the air outlet nozzle 12. Since the dividing wall 18 separates the initial air flow of the first fan 8 and the output air flow of the second fan 10, the device has the second pair of air inlets 22 to provide air to the second fan 10 to generate output air flow. The pressure of the output air flow through the nozzle may be increased by reducing the cross sectional area of the air outlet tube 14 and/or the air outlet nozzle 12 and making those cross-sectional areas small when compared to the cross-sectional area of the connecting tube 26 and the attachment provided by the suction device. Such an adjustment may be implemented by interchanging one nozzle as used for inflating tires with another nozzle for blowing dirt, or by simply providing for a cross section modifying screw or cap needle arrangement on the nozzle 12. A gauge for the nozzle 12 may be provided for use when inflating inflatables.

Alternatively, the pressure of the output air flow can be increased or decreased by moving a sliding cover 34 mounted on the outer surface of the center portion 6 and near the second pair of air inlets 22 as shown in FIG. 2. The sliding cover 34 can be slid to leave the air inlets completely open to the outside or closed to the outside, either completely or partially. Though as described, the sliding cover operates on only one of the pair of holes 22, the sliding mechanism may be paired with an another cover so as to adjust the size of each of the holes 22 simultaneously, or may be separated so that each hole of the pair of holes 22 is adjusted by its own cover 34. The strength of the air flow dependent also on the size, angle and number of blades of the fans 8 and 10, and any gearing devices which may be utilized. It is also dependent on the strength of the air-flow generating device being used.

The air flow device 2 provides a simple unit which can be attached to a suction device, such as a vacuum cleaner and instantly converts its air flow into a air blowing or expelling unit which can be used as a air pump or blower. The air expelled from the nozzle 12 might be used to inflate any inflatable article, such as balloons, tires, rafts or air mattresses, by adjusting the size and configuration of the tip of the nozzle 12. The air flow device may also be used to blow and remove undesired snow (with a strong enough suction device), dust, sand or other particulate matter from any surface. The air flow device 2 may be used to aid in removing dust and dirt from corners and areas where conventional vacuum cleaners may be inefficient. Further, a variety of different suction devices can be attached to the air flow device 2 through the connecting end 26 either by an adjustable clamp or a separate adapter. For example, FIG. 1 shows a connecting adapter 50 may be provided so as to connect a Black & Decker "Dust Buster."

Figure 3:
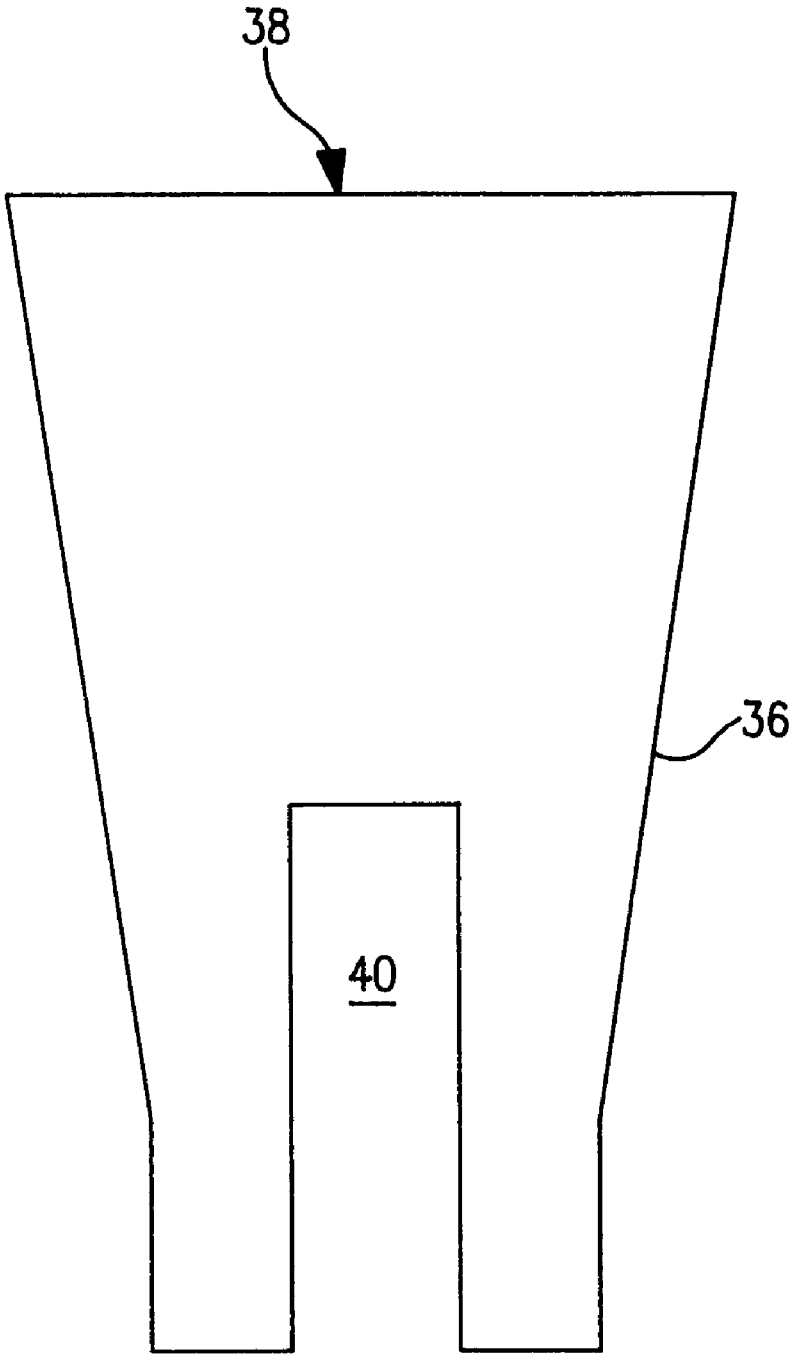
FIG. 3 shows a side view of the cowl of FIG. 2.

Referring to FIGS. 2 and 3, the air flow device 2, used as a dirt and dust remover, can be further modified by mounting a collecting cowl 36, which is tapered to have an open flared end, onto the housing 4. The open flared end of the collecting cowl 36 is disposed about the air outlet nozzle 12, but does not cover it. The cowl 36 has a frusto-conical or frusto-pyramidal shape and a pair of opposing slots 40 at the bottom end of the cowl so that the cowl 36 covers the first air inlets 20 without covering the second air inlets 22. Thus, output air still flows from outside the housing through the second inlets 22 to the air outlet nozzle 12, but the air taken into the first inlets 20 comes through the cowl 36 as shown by the flow line 42. Therefore, as the air expelled out of the nozzle 12 dislodges dust and other debris and lifts it off the surface thereby drawing the dust into the cowl 36 and through the second air inlets 20 as shown by the flow line 42. Thus, the air flow device 2 with the cowl 36, working in conjunction with a suction device, acts as an efficient dust and debris dislodger and collector.

To protect the first fan 8 from being damaged or its rotation being jammed by particulate material drawn through the first air inlets 20, the first inlets 20 can be configured to prohibit the entry of such material. For example, the first air inlets 20 may be configured so as to prohibit the entry of particulate material greater than a pre-determined size. To achieve this, the first air inlets 20 may be covered by mesh material or be formed by a series of relatively small holes in the wall of the center portion 6.

Figure 4:
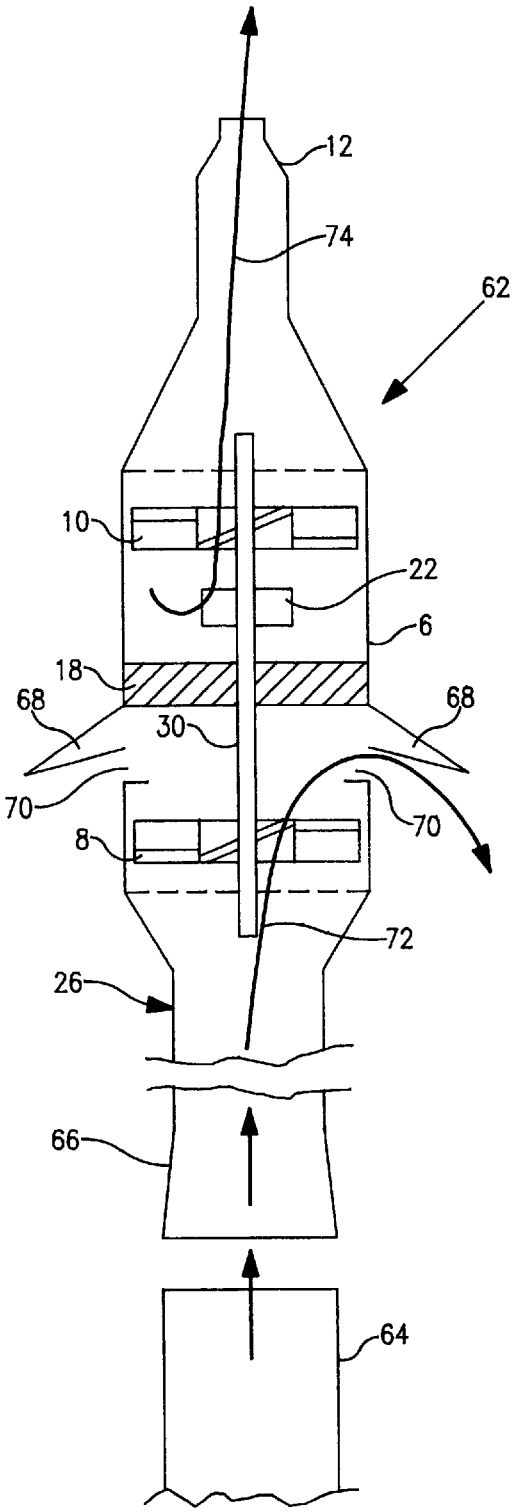
FIG. 4 shows a side sectional view of an alternate embodiment of the air flow modifying device of FIG. 1 designed to handle exhaust air such as from a vehicle exhaust.
Figure 5:
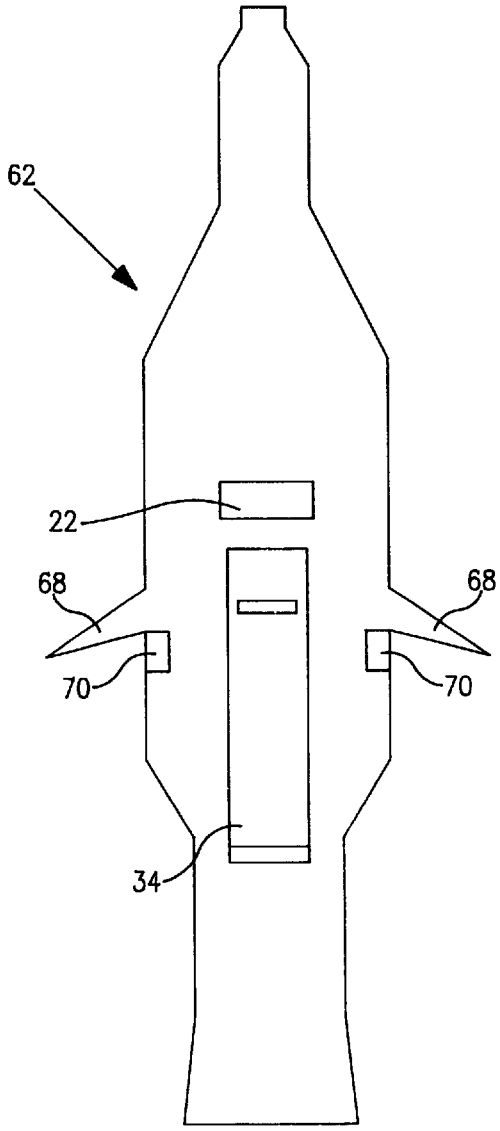
FIG. 5 shows a side view of the outer surface of the air flow modifying device in the embodiment shown in FIG. 4.

In an alternative embodiment, a second air flow device 62, as shown in FIGS. 4 and 5, is the same as the air flow device 2 except that it includes the modifications described below so that the air flow device 62 is driven by air expelled, for example, from a vehicle exhaust pipe 64. A long pipe or hose may be attached to the vehicle exhaust pipe 64 and then affixed to the connecting tube 26. Alternatively, the connecting tube 26 can be replaced by a length of pipe or hose 66 which is permanently attached to the central portion 6. Further, the blades of the first fan 8 must be in the same angular orientation with the blades of the second fan 10 so that when the first fan 8 rotates to create an initial exhaust gas flow, the second fan 10 will rotate to likewise expel clean air through the air outlet nozzle 12. Air flow deflectors 68 have been added to the outer surface of the center portion 6 of the housing 4 above the first air inlets 20 thereby converting them into air outlets 70, for expelling exhaust gas out therefrom. The deflectors 68 also prevent the vehicle exhaust from the air outlets 70 from mixing with the clean air expelled by the air outlet nozzle 12, and keep it away from the air flow device 62.

In this embodiment, once the exhaust pipe 64 is connected and the vehicle's engine is running thereby emitting exhaust gas through the pipe 64, the exhaust air flows in the direction shown by the flow line 72. Thus, the exhaust gas flows first through the fan 8 and then out the outlets 70, then collides with the deflectors 68. The exhaust gas flow through fan 8 causes the fan 8 to rotate and turn the central shaft 30 to turn the second fan 10 simultaneously. Since the blades of fan 8 and 10 are identical in their angular orientation, when the second fan 10 rotates, air is drawn into the air inlets 22, just as with air flow device 1, to be expelled from the nozzle 12 as the flow line 74 shows. Since the same dividing wall 18 of air flow device 2 separates the air region controlled by the first fan 8 and that region controlled by the second fan 10, the exhaust gas and the output air flow do not mix.

Figure 6:
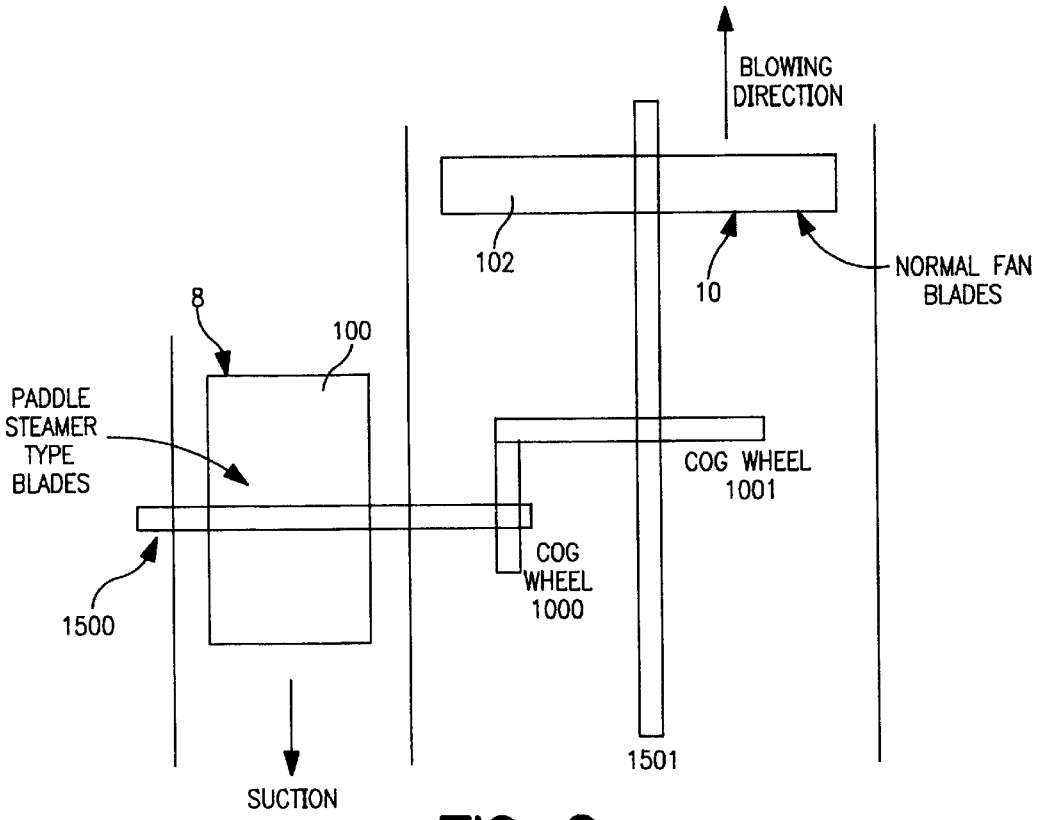
FIGS. 6 to 11 are schematic diagrams of alternative embodiments of an air flow modifying device.
Figure 8:
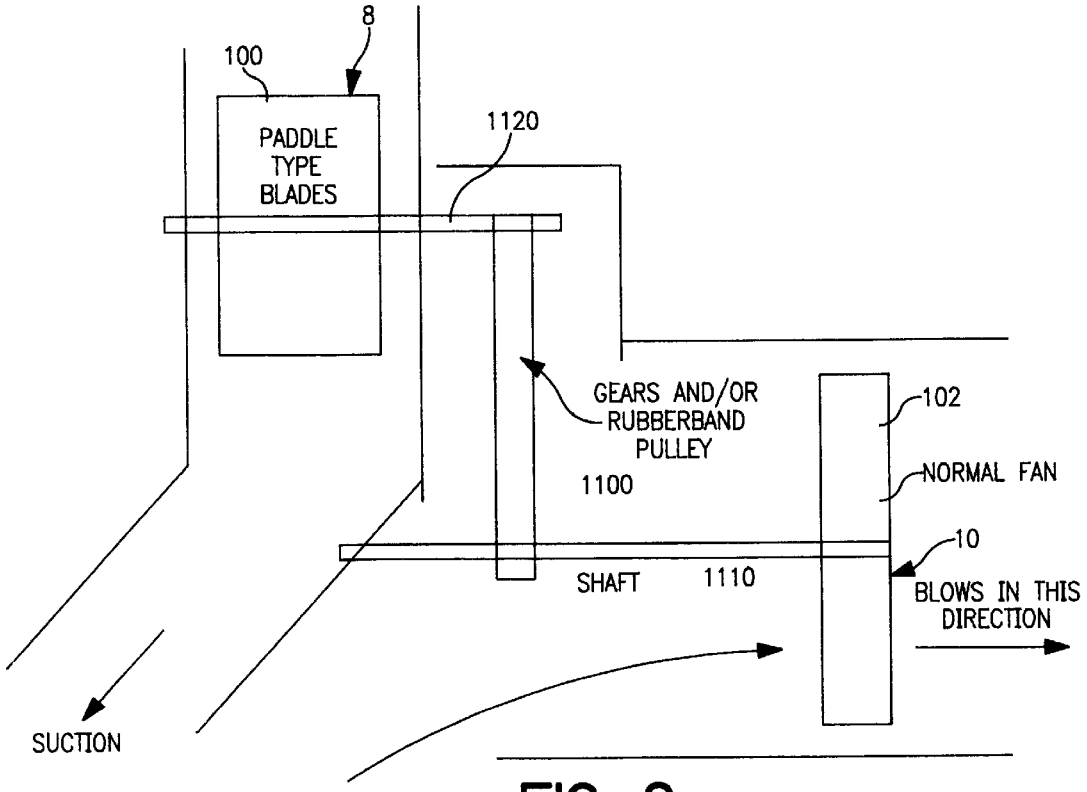
Figure 9:
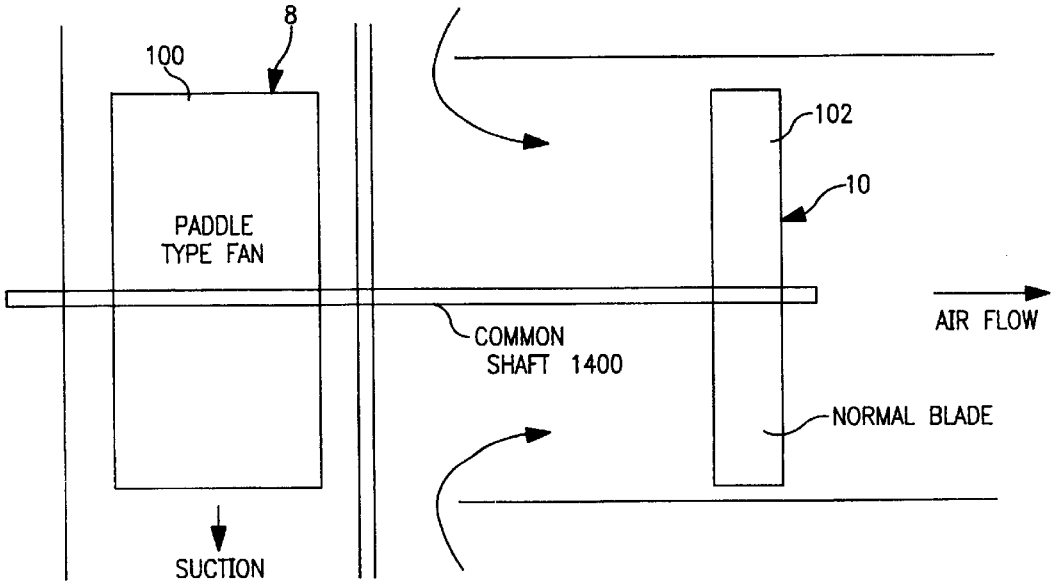

The fans 8 and 10 may be made of any rigid material, such as wood, plastic or metal and may be light to reduce the overall weight of the air flow devices 2 and 62. Similarly, any of the elements, such as the housing 4 and the dividing wall 18 may be made of such materials. The air flow devices 2 and 62 are light, with few moving parts, and requires no power source of their own. The air flow devices 2 and 62 have easily interchangeable end connectors and adapters to expand their use to industrial as well as consumer type applications. As shown below, fans 8 and 10 may either be normal propeller blade fans or paddle blade fans or a combination Further alternative embodiments of the present invention are illustrated in FIGS. 6–11. FIGS. 6–11 show how the fans 8 and 10 can be arranged in various positional relationships with respect to one another by adjusting the type of fan used and the coupling arrangement between the fans. For example, FIGS. 6–9 illustrate how the two fans can essentially be arranged alongside or perpendicular to one another by using either two paddle fan blades 100, as in FIG. 7, or a combination of a paddle fan 100 and a normal propeller fan blade 102, as shown in FIGS. 6, 8 and 9. FIG. 6 shows paddle fan blades 100 having an axis of rotation perpendicular to normal propeller fan blades 102. The two fans 8 and 10 in FIG. 6 are coupled by a set of perpendicular cog wheels 1000 and 1001. Cog wheel 1001 is connected to a corresponding shaft 1501. Cog wheel 1000 is connected is also connected to a shaft 1500.

Figure 7:
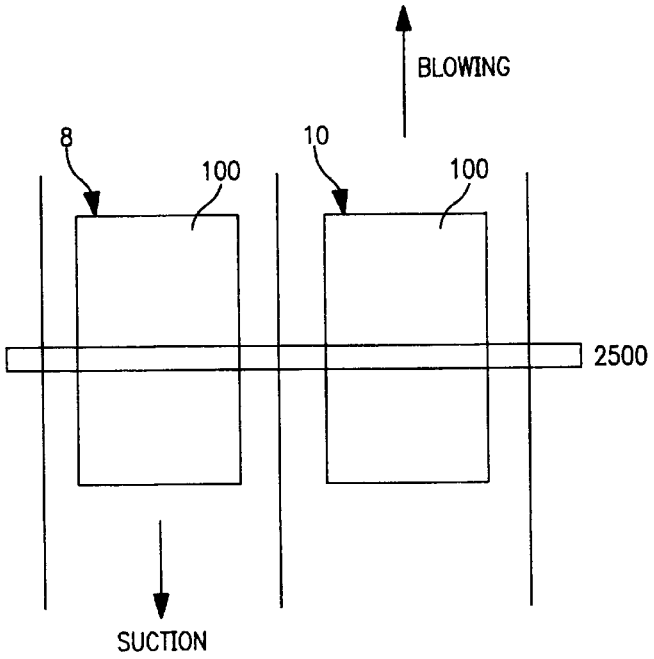

FIG. 7 shows a set of two paddle fans 8 and 10 having paddle blades 100 which utilize the same shaft or axle 2500. Cogs and gearing means (not shown) may be implemented as appropriate to the design.

FIG. 8 shows a fan 8 with paddle blades 100 coupled via gears and/or a rubberband,pulley to a shaft 1110 which is rotated. The shaft is then coupled directly to fan 10 with normal propeller blades 102 which blow air out. Fan 8 is also rotated using a separate shaft 1120.

FIG. 9 shows a common shaft 1400 which couples directly paddle blades 100 of fan 8 with normal propeller blades 102 of fan 10.

Figure 10:
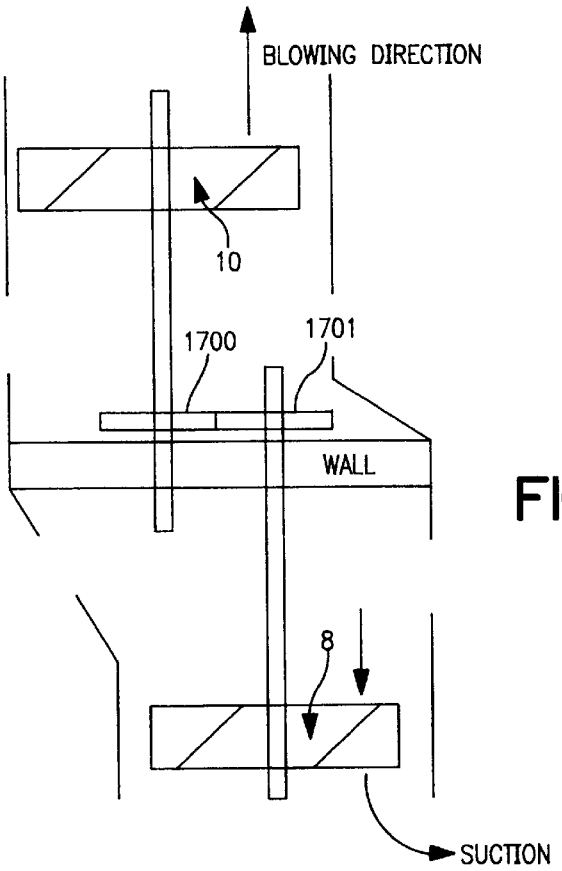
Figure 11:
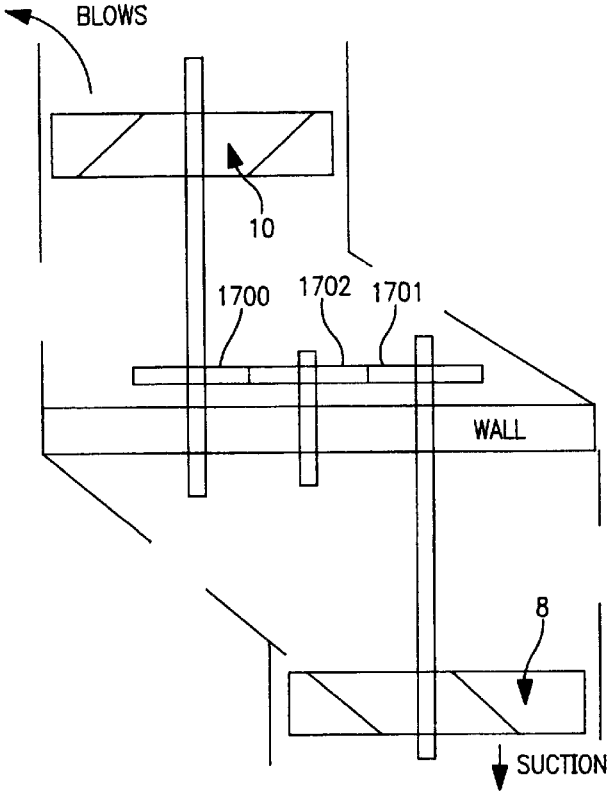

FIGS. 10 and 11 show how the coupling arrangement between the fans 8 and 10 can be altered so that the axis of one fan 8 is offset with respect to the axis of the other fan 10.

FIG. 10 has two fans 8 and 10 which normal blades pitched the same directly. Two center cogs 1700 and 1701 force the fans 8 and 10 to rotate opposite one another.

FIG. 11 has two fans 8 and 10 with normal propeller blades pitched in opposite directions. An extra third cog 1702 is added to cogs 1700 and 1701 such that opposing rotation is maintained.

Though the present invention has been described with regard to certain preferred embodiments, those skilled in the art will recognize that several different variations of the invention are possible.

What is claimed is:

1. An apparatus including:

first air port means for allowing a passage of a first air flow;

first fan means, said first air flow generated by rotation of said first fan means;

second fan means for rotating coupled to said first fan means, said second fan means having opposite blade orientation from that of said first fan means so that the first air flow is in opposite direction to a second air flow;

a tubular housing enclosing and coupled to the first fan means and the second fan means, with one end of said housing terminating at the first air port means;

a wall coupled to an inside surface of the housing which separates the first fan means from the second fan means; and second air port means for allowing a passage of a second air flow, said second air flow generated by rotation of said second fan means, wherein said first fan means and said second fan means are disposed between said first air port means and said second air port means.

2. An apparatus as claimed in claim 1, including a third air port means for allowing a passage of said first air flow and a fourth air port means for allowing a passage of said second air flow, said third air port means and said fourth air port means associated with said first and second fan means, respectively.

3. An apparatus as claimed in claim 2, wherein the first and second air port means are at opposite ends of said apparatus.

4. An apparatus as claimed in claim 2, wherein said fourth air port means is an air inlet and the direction of said second air flow is from said fourth air port means to said second air port means.

5. An apparatus as claimed in claim 4, wherein the third air port means is an air inlet so as to draw air therethrough, the direction of said first air flow being from the third air port means to the first air port means.

6. An apparatus as claimed in claim 5, including an attachable connector coupled to said first air port means.

7. An apparatus as claimed in claim 5, including an attachable cowl means coupled to the housing so as to provide a wide opening disposed about the second air port means, such that said wide opening draws air therethrough that flows via the third air port means to the first air port means.

8. An apparatus as claimed in claim 1, wherein the axis of rotation of the first fan means is aligned with the axis of rotation of the second fan means.

9. An apparatus as claimed in claim 1, wherein the axis of rotation of the first fan means is at an angle with respect to the axis of rotation of the second fan means.

10. An apparatus as claimed in claim 9, wherein the axis of rotation of the first fan means is substantially perpendicular to the axis of rotation of the second fan means.

11. An apparatus as claimed in claim 1, wherein said first fan means and said second fan means are identical in diameter.

12. An apparatus for modifying air flow comprising:

a first air port coupled to a vacuum source;

a first fan having a plurality of blades which rotate in response to an input air flow generated by said vacuum source;

a second fan, having a plurality of blades, coupled to said first fan by a shaft wherein the rotation of the blades of the first fan causes the blades of the second fan to rotate;

a tubular housing enclosing and coupled to the first fan and the second fan, with one end of said housing terminating at the first air port;

a wall coupled to the inside surface of the housing which separates the first fan from the second fan and wherein said shaft penetrates through the wall and rotates without impediment;

a second air port, at a second end of said housing, wherein an output air flow, generated by rotation of said second fan, passes through said second air port and exits outside said housing;

a first pair of air inlets disposed about the surface of the housing proximate to the first fan, wherein said first pair of air inlets passes air adjacent to the first pair of air inlets from outside of the tubular housing to enter inside the tubular housing; and a second pair of air inlets disposed about the surface of the housing proximate to the second fan, wherein said second pair of air inlets passes air adjacent to the second pair of air inlets from outside the tubular housing to inside the tubular housing.

13. An apparatus as in claim 12 wherein the blades of said first fan are opposite in orientation to the blades of the second fan so that the output air flow is opposite in direction to the input air flow.

14. An apparatus as in claim 13 wherein said second air port has a nozzle directing and restricting the output air flow as it passes air from inside the tubular housing to outside the tubular housing.

15. An apparatus as in claim 14 further comprising adjustable connecting means for attaching said air flow generating device to said vacuum source.

16. An apparatus as in claim 14 wherein the direction of the output air flow is from said second pair of air inlets toward the said second air port.

17. An apparatus as in claim 14 wherein the direction of the input air flow is from said first pair of air inlets toward the first air port.

18. An apparatus as in claim 14 wherein the first air port includes a connector for attaching to said vacuum source.

19. An apparatus as in claim 14 wherein said nozzle adjusts to vary the pressure of said output air flow exiting therefrom.

20. An apparatus as in claim 14 wherein said second pair of air inlets includes a sliding cover for adjusting the volume of air coming from outside the tubular housing.

21. An apparatus as in claim 14 which further comprises a cowl means detachably coupled to said tubular housing providing an opening, which is wider than said tubular housing, disposed about the second air port, wherein said cowl means draws particles and air, disturbed to motion by the output air flow, into the first pair of air inlets through to the first air port for collection by said vacuum source.

22. An apparatus including:

a body;

first air port means for allowing a passage of a first air flow;

first fan means, said first air flow generated by rotation of said first fan means;

second fan means for rotating coupled to said first fan means, said second fan means having opposite blade orientation from that of said first fan means so that the first air flow is in opposite direction to a second air flow;

second air port means for allowing a passage of a second air flow, said second air flow generated by rotation of said second fan means, wherein said first fan means and said second fan means are disposed between said first air port means and said second air port means and said second air flow flows in the opposite direction of said first air flow;

a third air port means for allowing a passage of said first air flow and a fourth air port means for allowing a passage of said second air flow, said third air port means and said fourth air port means associated with said first and second fan means, respectively; and an attachable cowl means coupled to the body so as to provide a wide opening disposed about the second air port means, such that said wide opening draws air there through that flows via the third air port means to the first air port means, wherein said second fan means is configured such that said fourth air port means acts as an air inlet and the direction of said second air flow is from said fourth air port means to said second air port means and the first fan means is configured such that the third air port means acts as an air inlet so as to draw air therethrough, the direction of said first air flow being from the third air port means to the first air port means.

23. An apparatus including:

first air port means for allowing a passage of a first air flow;

first fan means, said first air flow generated by rotation of said first fan means;

second fan means for rotating coupled to said first fan means, said second fan means having opposite blade orientation from that of said first fan means so that the first air flow is in opposite direction to a second air flow; and second air port means for allowing a passage of a second air flow, said second air flow generated by rotation of said second fan means, wherein said first fan means and said second fan means are disposed between said first air port means and said second air port means, wherein the axis of rotation of the first fan means is at an angle with respect to the axis of rotation of the second fan means.

24. An apparatus including:

first air port means for allowing a passage of a first air flow;

first fan means, said first air flow generated by rotation of said first fan means;

second fan means for rotating coupled to said first fan means, said second fan means having opposite blade orientation from that of said first fan means so that the first air flow is in opposite direction to a second air flow; and second air port means for allowing a passage of a second air flow, said second air flow generated by rotation of said second fan means, wherein said first fan means and said second fan means are disposed between said first air port means and said second air port means, wherein the axis of rotation of the first fan means is at an angle with respect to the axis of rotation of the second fan means and the axis of rotation of the first fan means is substantially perpendicular to the axis of rotation of the second fan means.

* * * * *